US009157389B2

(12) United States Patent
Nonoyama et al.

(10) Patent No.: US 9,157,389 B2
(45) Date of Patent: Oct. 13, 2015

(54) APPARATUS OF ESTIMATING FUEL STATE

(75) Inventors: Yoshiharu Nonoyama, Nagoya (JP); Naoyuki Yamada, Kariya (JP)

(73) Assignee: DENSO CORPORATION, Kariya (JP)

( * ) Notice: Subject to any disclaimer, the term of this patent is extended or adjusted under 35 U.S.C. 154(b) by 806 days.

(21) Appl. No.: 13/435,933

(22) Filed: Mar. 30, 2012

(65) Prior Publication Data

US 2012/0253639 A1 Oct. 4, 2012

(30) Foreign Application Priority Data

Apr. 1, 2011 (JP) ..... 2011-082197

(51) Int. Cl.
*F02D 41/00* (2006.01)

(52) U.S. Cl.
CPC .... *F02D 41/0025* (2013.01); *F02D 2200/0602* (2013.01); *F02D 2200/0606* (2013.01); *F02D 2200/0608* (2013.01)

(58) Field of Classification Search
CPC ..... F02D 2200/0602; F02D 2200/0606; F02D 2200/0608; F02D 41/0025
USPC ..... 701/101–104; 123/381, 387, 445, 447, 123/456–458, 464, 472, 476, 478, 490, 123/494; 73/114.45, 114.49, 114.51; 239/71, 900; 374/144
See application file for complete search history.

(56) References Cited

U.S. PATENT DOCUMENTS 8,191,412 B2 * 6/2012 Doring ..... 73/114.71
2005/0049777 A1 * 3/2005 Fritsch et al. ..... 701/104
2006/0130569 A1 * 6/2006 Walther et al. ..... 73/119 A
2008/0228374 A1 9/2008 Ishizuka et al.
2009/0139499 A1 * 6/2009 Barra et al. ..... 123/552
2009/0178474 A1 7/2009 Bailey
2009/0205413 A1 * 8/2009 Yamauchi et al. ..... 73/114.41
2010/0126469 A1 * 5/2010 Park ..... 123/456
2010/0250095 A1 9/2010 Yamada et al.
2010/0308979 A1 * 12/2010 Takashima ..... 340/286.02
2010/0312457 A1 12/2010 Yoshida
2010/0312501 A1 12/2010 Komatsu
2010/0319443 A1 12/2010 Nakata et al.
2010/0319445 A1 12/2010 Yamada
2011/0308497 A1 * 12/2011 Yamada et al. ..... 123/458
2012/0020384 A1 * 1/2012 Mikami ..... 374/144

FOREIGN PATENT DOCUMENTS

JP 2005-180190 7/2005
JP 2011-047280 3/2011

OTHER PUBLICATIONS

Office Action (2 pages) dated Jul. 2, 2013, issued in corresponding Japanese Application No. 2011-082197 and English translation (2 pages).

* cited by examiner

*Primary Examiner* — Erick Solis
*Assistant Examiner* — Carl Staubach
(74) *Attorney, Agent, or Firm* — Nixon & Vanderhye PC

(57) ABSTRACT

An apparatus extracts a main waveform component and a branch waveform component from a pressure waveform detected by a fuel pressure sensor. The main waveform component is caused by pressure change traveling in a main passage. The branch waveform component is caused by pressure change traveling in a branch passage. The apparatus calculates traveling speeds based on the components. Then, the apparatus estimates a main passage temperature based on a detected value of the fuel temperature sensor, the traveling speeds, the fuel pressure waveform and an average pressure.

10 Claims, 10 Drawing Sheets

APPARATUS OF ESTIMATING FUEL STATE

CROSS REFERENCE TO RELATED APPLICATION

This application is based on Japanese Patent Application No. 2011-82197 filed on Apr. 1, 2011, the disclosure of which is incorporated herein by reference.

TECHNICAL FIELD

The present disclosure relates to an apparatus of estimating fuel state, such as a temperature of fuel and a fuel property to be injected from an injector.

BACKGROUND

Documents 1 to 5 all disclose an apparatus which detects a fuel pressure supplied to an injector by a fuel pressure sensor and detects a fuel pressure waveform that is pressure change caused by fuel injection. The apparatus calculates injection condition based on the fuel pressure waveform. For example, since the fuel pressure waveform begins dropping in response to an initiation of injection, it is possible to calculate an injection start timing by detecting a start timing of the pressure dropping. According to the apparatus, it is possible to control injection condition to a desired condition by carrying out a feedback control on operation of an injector based on the calculated injection condition.

A body of the injectors disclosed in the documents 1 to 5 is formed with a supply inlet, a nozzle hole, and passages. The supply inlet receives fuel delivered from a common rail, which is also known as a pressure accumulation container. The nozzle hole is provided to inject fuel. The passages include a main passage extending from the supply inlet to the nozzle hole and a branch passage which is branched from the main passage. The documents 1 to 5 also disclose a fuel pressure sensor disposed to detect a pressure of fuel in the branch passage. According to the structure, fuel pressure in the main passage first drops at a portion close to the nozzle hole in response to a beginning of injection from the nozzle hole. Then, pressure change travels through the main passage and the branch passage, and then, reaches to the fuel pressure sensor. Therefore, the fuel pressure sensor detects the traveled pressure change as a fuel pressure waveform.

However, a traveling speed of pressure in the main passage and the branch passage varies as a temperature of fuel is changed. As a result, a correlation between the fuel pressure waveform and the injection condition is also varied as a temperature of fuel is changed. For example, a delay time from a beginning of injection to the pressure dropping timing is varied as a temperature of fuel is changed.

In order to reduce influences caused by a fuel temperature, the apparatuses in the documents 1 to 5 has sensors for detecting fuel temperature in the branch passage. The apparatuses tried to calculate the injection condition in an accurate manner by correcting the fuel pressure waveform based injection condition calculating processing based on a fuel temperature detected by the fuel temperature sensor.

Document 1: JP-2010-285887A
Document 2: JP-2010-285889A
Document 3: JP-2010-286280A
Document 4: JP-20114842A
Document 5: JP-2011-1915A

SUMMARY

However, fuel in a portion close to the nozzle hole is heated by the heat of the internal combustion engine. There must be a certain amount of difference between a temperature of fuel in the branch passage that is detected by the fuel pressure sensor and a temperature at the portion close to the nozzle hole. Therefore, the detected temperature based correction may not provide a proper correction.

In addition, a traveling speed of pressure change in the passage is also varied by a fuel property, such as a kind of fuel. Therefore, the injection condition may not be calculated properly, if a fuel that is different from expected is supplied. In addition, since such sensor may increase the number of components and increase the cost, it is not desirable to install a sensor for detecting a fuel property.

It is an object of the present disclosure to provide a fuel state estimating apparatus which is capable of estimating fuel state.

It is another object of the present disclosure to provide a fuel state estimating apparatus which can properly estimate fuel state in a main passage based on values detected by a fuel pressure sensor and a fuel temperature sensor disposed in a branch passage that is branched from the main passage.

According to the present disclosure, an apparatus of estimating fuel state being applied to a fuel injection system is provided. In an embodiment, the fuel injection system may have an injector which injects fuel for combustion in an internal combustion engine. The fuel injection system may have a pressure accumulation container which contains pressurized fuel and supplies the pressurized fuel to the injector. The fuel injection system may has a fuel pressure sensor configured to detect a fuel pressure in a branch passage, which is branched from a main passage extending between an outlet of the pressure accumulation container and a nozzle hole of the injector. The fuel injection system may has a fuel temperature sensor configured to detect a branch fuel temperature in the branch passage.

In an embodiment, the apparatus may comprises a main extraction section which extracts a main waveform component from a pressure waveform detected by the fuel pressure sensor, the main component being a component in the pressure waveform and caused by pressure vibration traveling in the main passage, and a branch extraction section which extracts a branch waveform component from the pressure waveform, the branch component being a component in the pressure waveform and caused by pressure vibration traveling in the branch passage. The apparatus may comprises a branch velocity calculation section which calculates a branch velocity, which is a velocity of pressure wave traveling in the branch passage, based on the branch waveform component, and a main velocity calculation section which calculates a main velocity, which is a velocity of pressure wave traveling in the main passage, based on the main waveform component. The apparatus may comprises an average pressure calculation section which calculates an average pressure of fuel supplied to the injector based on the pressure waveform. The apparatus may comprises a fuel state estimation section which estimates a main fuel state, which is fuel state relating to fuel in the main passage, based on the branch fuel temperature, the branch velocity, the main velocity, and the average pressure. In one of embodiments, the fuel state estimation section estimates a main fuel temperature in the main passage. In one of embodiments, the fuel state estimation section includes a fuel property estimation section which estimates a fuel property based on the branch fuel temperature, the branch velocity, and the average pressure, and a main temperature estimation section which estimates the main fuel temperature based on the fuel property estimated by the fuel property estimation section, the main velocity and the average pressure. In one of embodiments, the fuel state estimation section estimates a fuel property. The fuel state estimation section may include a fuel property estimation section which estimates the fuel property based on the branch fuel temperature, the branch velocity, and the average pressure. Due to the structure of the main passage and the branch passage, the fuel pressure sensor on the injector merely detects the pressure in the branch passage. The detectable pressure includes the main waveform component WL and the branch waveform component WS. The main waveform component may reflect fixed parameters relating to the main passage and variable parameters relating to the fuel state in the main passage. Similarly, the branch waveform component may reflect fixed parameters relating to the branch passage and variable parameters relating to the fuel state in the branch passage. Therefore, it is possible to calculate the fuel state in the main passage, based on the branch fuel temperature, the branch velocity, the main velocity, and the average pressure.

The main waveform component has a frequency depending on a fuel temperature in the main passage and a main passage length, etc.

Similarly, the branch waveform component has a frequency depending on a fuel temperature in the branch passage and a branch passage length, etc.

A bulk modulus of fuel and a density of fuel are physical quantities defined by a property of fuel. A ratio of the bulk modulus and the density can be calculated theoretically based on parameters such as a velocity of pressure wave traveling in a passage, a pressure in a passage, and a fuel temperature.

The fuel temperature in the branch passage may be acquired by the fuel temperature sensor. The velocity, i.e., branch velocity in the branch passage may be calculated from a frequency of the branch waveform component and a branch passage length of the branch passage. The pressure in the passage may be substituted by the average pressure in the branch passage. Therefore, it is possible to determine a fuel property based on the parameters.

The velocity, i.e., main velocity in a main passage may be calculated from a frequency of the main waveform component and a main passage length. The fuel property can be determined based on the parameters. The pressure in the main passage may be substituted by the average pressure in the branch passage. Therefore, it is possible to determine a fuel temperature in the main passage based on the parameters.

In other words, it is possible to determine a fuel temperature in the main passage based on the parameters.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Hereafter, a plurality of embodiments of the present disclosure are described based on the drawings. An apparatus for estimating fuel state and a method for estimating fuel state is described. The apparatus is designed to control an internal combustion engine, i.e., engine. The apparatus designed to be mounted on a vehicle to control an engine for driving the vehicle. The engine may be a diesel engine which is supplied with high-pressure fuel and performs compression-self-ignition combustion. The engine is a multi-cylinder engine. In the following embodiment, the engine is a four-cylinder engine having a cylinder #1 to a cylinder #4. The reference symbols #1, #2, #3, and #4 may be used to identify one specific cylinder. The reference symbols #1, #2, #3, and #4 may also be used to identify components or characteristics related to or depending on the identified cylinder, e.g., an injector, i.e., fuel injection valve, provided for the identified cylinder.

(First Embodiment)

Figure 1:
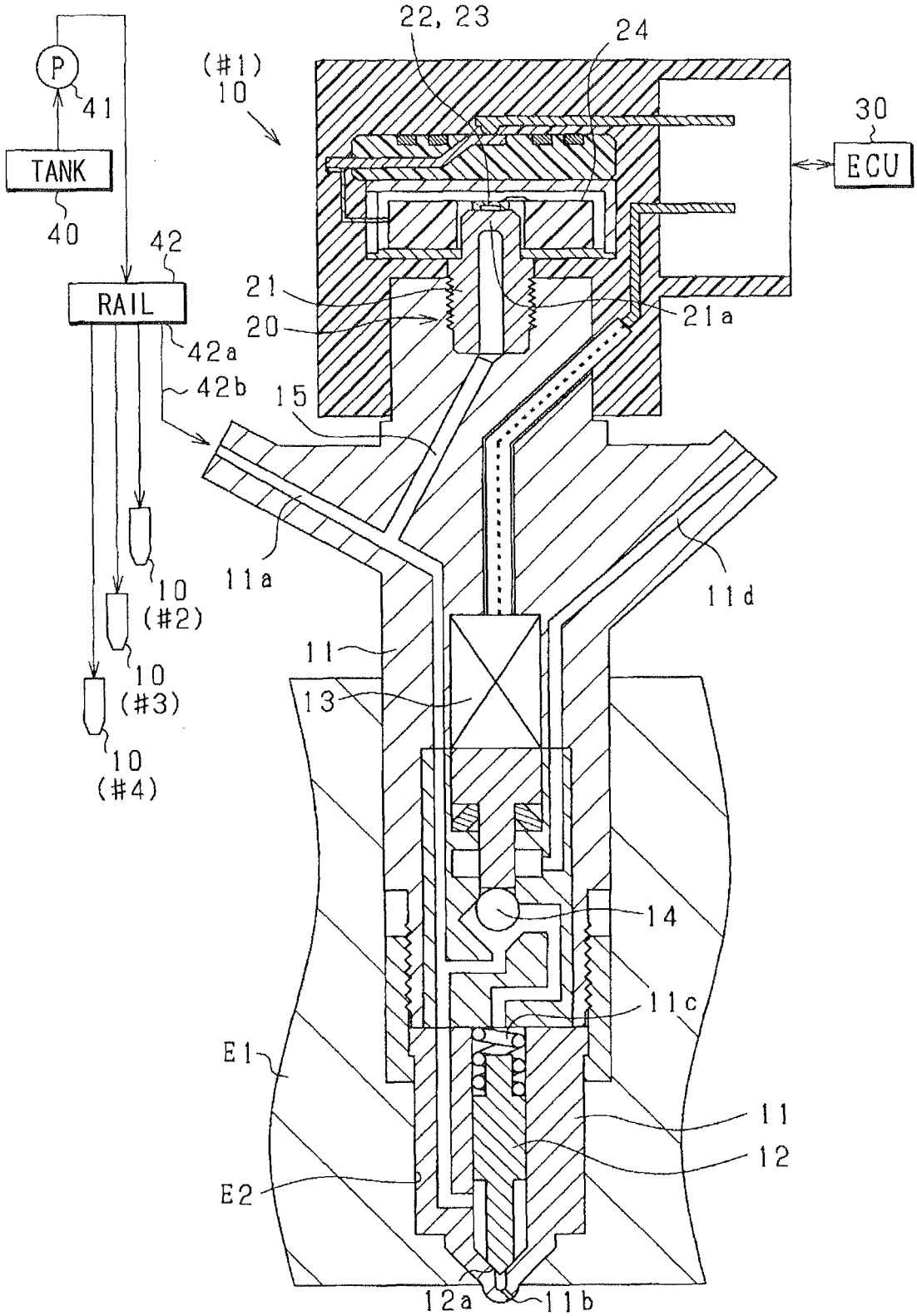
FIG. 1 is a diagram showing a fuel injection system and an injector according to a first embodiment of the present disclosure.

FIG. 1 shows components of a fuel injection system according to a first embodiment of the present disclosure. The fuel injection system includes a plurality of injectors 10. Each of the injectors 10 is provided for corresponding cylinder of the engine. The injector 10 has a sensor unit 20 which detects fuel pressure in the injector 10 and outputs electric signal indicative of the detected fuel pressure. The fuel injection system further includes an electronic control unit (ECU) 30. The fuel injection system is mounted on a vehicle.

The injectors 10 are components of the fuel injection system. The fuel injection system includes a fuel tank 40 for liquid diesel fuel. The fuel injection system includes a fuel pump 41 and a common rail 42 for providing a fuel supply system. The fuel pump 41 draws fuel in the fuel tank 40 and pressurizes fuel. The fuel pump 41 supplies pressurized fuel to the rail 42. The rail 42 is used as a pressurized fuel container. The rail 42 also works as a delivery device which delivers pressurized fuel to the injectors 10. The injectors 10 for the cylinders #1 to #4 inject fuel one by one in a predetermined order. The fuel pump 41 is provided by a plunger pump. Therefore, fuel is pressurized in a synchronizing manner with reciprocation of a plunger. The fuel injection system is configured to accumulate fuel pressurized by the fuel pump 41 in the pressurized fuel container 42. The fuel injection system is configured to deliver pressurized fuel from the pressurized fuel container 42 to the injectors 10.

The injector 10 has a body 11, a valve member 12 having a needle shape, and an actuator 13. The body 11 defines a high pressure passage 11*a* therein and at least one nozzle hole 11*b* which injects fuel into the corresponding cylinder. The valve member 12 is accommodated in the body 11 in a movable manner, and opens and closes the nozzle hole 11*b*.

The body 11 defines a backpressure chamber 11*c* which applies a backpressure to the valve member 12. The high pressure passage 11*a* is formed to be capable of communicating the backpressure chamber 11*c*. The body 11 also defines a low pressure passage 11*d* which is formed to be capable of communicating the backpressure chamber 11*c*. The injector 10 has a control valve 14 which switches communications to the backpressure chamber 11. The control valve 14 selectively provides a communication between the backpressure chamber 11*c* and the high pressure passage 11*a* and a communication between the backpressure chamber 11*c* and the low pressure passage 11*d*. The control valve 14 is operated by the actuator 13 such as an electromagnetic coil and a piezo-electric device. When the actuator 13 is activated and pushes the control valve 14 downwardly in the drawing, the backpressure chamber 11*c* is communicated with the low pressure passage 11*d* so that pressure in the backpressure chamber 11*c* is lowered. As a result, the backpressure applied to the valve member 12 is decreased. The valve member 12 is lifted upwardly to open the valve. On the other hand, when the actuator 13 is deactivated and allows the control valve 14 to move upwardly in the drawing, the backpressure chamber 11*c* is communicated with the high pressure passage 11*a* so that pressure in the backpressure chamber 11*c* is increased. As a result, the backpressure applied to the valve member 12 is increased. The valve member 12 is urged downwardly to close the valve.

Therefore, the opening-and-closing operation of the valve member 12 is controlled by controlling the actuator 13 by the ECU 30. Thereby, the high pressure fuel supplied to the high pressure passage 11*a* from the rail 42 is injected from the nozzle hole 11*b* according to the opening-and-closing operation of the valve member 12.

A branch passage 15 is formed in a body 11 of the injector 10. The branch passage 15 is branched from the high pressure passage 11*a* and is extended to an injector upper end which is opposite to the nozzle hole 11*b*. Fuel in the high pressure passage 11*a* is introduced to the sensor unit 20 via the branch passage 15. In this embodiment, a fuel passage extending from an outlet 42*a* of the common rail 42 to the nozzle hole 11*b* corresponds to a main passage. In detail, the main passage is provided by a passage in the high pressure pipe 42*b* and the high pressure passage 11*a* formed in the body 11. The high pressure pipe 42*b* communicates the common rail 42 and the injector 10.

A portion of the body 11 close to the nozzle hole 11*b* is inserted and disposed in an insertion hole E2 formed on a cylinder head E1 of the engine. The injector 10 is mounted on the engine so that the nozzle hole 11*b* is directly exposed to a combustion chamber of the engine. The body 11 has a downstream side body and an upstream side body. A portion of the body 11 inserted within the cylinder head E1 provides the downstream side body. A portion of the body 11 placed outside the cylinder head E1 provides the upstream side body. A part of the main passage 11*a* and the nozzle hole 11*b* are formed in the downstream side body. The branch passage 15 is formed in the upstream side body. The downstream side body is configured to be inserted in the cylinder head E1 of the internal combustion engine, while the upstream side body is configured to be located on an outside of the cylinder head E1. The branch passage 15 is located in the upstream side portion.

The system includes a plurality of sensor unit 20. The sensor unit 20 is mounted on the injectors 10 respectively. The sensor unit 20 is configured to have components such as a stem 21, a pressure sensor 22, a fuel temperature sensor 23, and a molded integrated circuit 24. The stem 21 is a member for generating distortion corresponding to pressure and applies generated distortion to the pressure sensor 22. The stem 21 is attached to the body 11. The stem 21 provides a diaphragm portion 21*a* which can be deformed resiliently in response to pressure of fuel in the high pressure passage 11*a*. The fuel pressure sensor 22 is attached to the diaphragm portion 21*a*. The fuel pressure sensor 22 generates a signal indicative of an amount of resilient deformation on the diaphragm portion 21*a* and outputs the signal to the ECU 30. The fuel pressure sensor 22 is provided by a pressure sensing element.

A fuel temperature sensor 23 provided by a temperature sensing element is attached on the diaphragm portion 21*a*. A temperature detected by the fuel temperature sensor 23 may be assumed as a temperature of fuel in the branch passage. That is, the sensor unit 20 includes a portion which detects a temperature of fuel in the branch passage.

The molded integrated circuit 24 is mounted on the injector 10 with the stem 21. The molded integrated circuit 24 has a resin mold which covers electronic components such as an amplifier circuit and a transmitter circuit. The amplifier circuit amplifies detection signals outputted from the fuel pressure sensor 22 and the fuel temperature sensor 23. The molded integrated circuit 24 is electrically connected with the ECU 30. The transmitter circuit transmits the amplified detection signal to the ECU 30.

The ECU 30 calculates a target injection state based on input signals indicative of operating condition of the engine. The target injection state may be shown by at least one of a number of injection stages, an injection start timing, an injection finish timing, and a fuel injection amount. The input signals may include at least one of an operated amount of an accelerator, an engine load, and an engine rotation speed NE, etc. For example, the ECU 30 may have a section or module that can set the target injection state based on a map. The map may store the optimal injection state corresponding to the operating condition of the engine, such as an engine load and an engine rotation speed. In this case, the apparatus provided by the ECU 30 calculates the target injection state by looking up the map based on present values of the engine load and the engine rotation speed. Then, the apparatus sets injection command signals corresponding to the calculated target injection state based on injection rate parameters td, te, Rα (R-Alpha), Rβ (R-Beta), and Rmax. The injection command signals may be defined by parameters such as t1, t2 and Tq shown in FIG. 2. The apparatus outputs the injection command signals to the injectors 10 and controls the injectors 10. A leading edge of the injection command signal defines a start timing t1 of injection and may be referred to as an injection start command signal. Duration of the injection command signal defines an amount of injected fuel. A trailing edge of the injection command signal defines a finish timing t2 of injection and may be referred to as an injection finish command signal.

Figure 2:
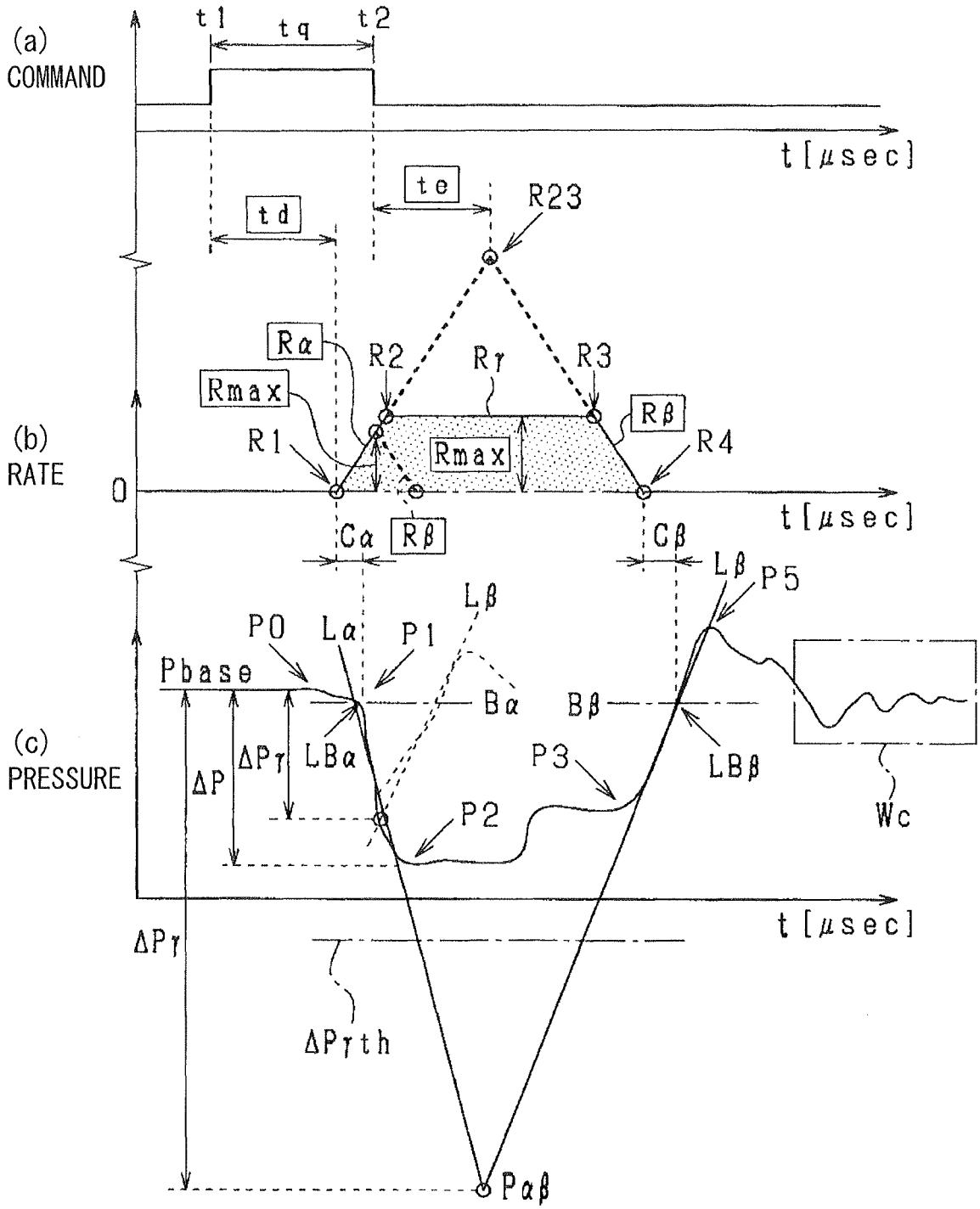
FIG. 2 is a timing diagram showing behavior of the fuel injection system in response to an injection command signal.

The apparatus outputs an injection command signal as shown in a waveform (a) in FIG. 2. The injector 10 injects fuel in response to the injection command signal. The fuel pressure sensor 22 detects fuel pressure supplied to the corresponding injector 10. The apparatus monitors fuel pressure change caused by fuel injection and detects a waveform of fuel pressure showing the fuel pressure change caused by the fuel injection. A waveform (c) in FIG. 2 shows an example of a waveform of fuel pressure. The apparatus calculates a waveform of injection rate as shown in a waveform (b) in FIG. 2. The waveform of injection rate shows change of an amount of fuel injected per unit time. The injection rate may be calculated based on the fuel pressure waveform detected. The apparatus calculates injection rate parameters Rα, Rβ, and Rmax which identifies a waveform of the injection rate. The apparatus learns the injection rate parameters by storing them. The injection rate waveform shows injection state. The apparatus calculates a correlation between the injection command signal and the injection state. The correlation may be calculated as a mathematical function such as a correlation coefficient between the injection command signal and the injection state. The injection command signal is defined by the start timing t1, the duration Tq, and the finish timing t2. The apparatus may calculate injection rate parameters, such as td, and te, which defines a correlation between the injection command signal and the injection state. The apparatus learns the correlation by storing the injection rate parameters td and te.

In detail, the apparatus calculates a descent approximation straight-line Lα (L-Alpha) based on the detected waveform by using known method, such as the least square method. The descent approximation straight-line Lα approximates a descending part of the waveform from an inflection point P1 where a drop of fuel pressure begins in response to a start of injection to an inflection point P2 where a drop of fuel pressure ends. Then, the apparatus calculates a timing where the descent approximation straight-line Lα reaches to a reference value Bα (B-Alpha). The timing is defined as a crossing timing LBα where the line Lα crosses the level Bα. According to the inventor's analysis, a start timing R1 of fuel injection has high correlation with the crossing timing LBα. The apparatus calculates a start timing R1 of fuel injection based on the crossing timing LBα. For example, the apparatus may be configured to calculate the injection start timing R1 by calculating a timing before the crossing timing LBα by a predetermined delay time Cα.

The apparatus calculates an ascent approximation straight-line Lβ (L-Beta) based on the detected waveform by using known method, such as the least square method. The ascent approximation straight-line Lβ approximates an ascending part of the waveform from an inflection point P3 where an ascending of fuel pressure begins in response to a finish of injection to an inflection point P5 where the ascending of fuel pressure ends. Then, the apparatus calculates a timing where the ascent approximation straight-line Lβ reaches to a reference value Bβ (B-Beta). The timing is defined as a crossing timing LBβ where the line Lβ crosses the level Bβ. According to the inventor's analysis, a finish timing R4 of fuel injection has high correlation with the crossing timing LBβ. The apparatus is designed based on the analysis, and calculates a finish timing R4 of fuel injection based on the crossing timing LBβ. For example, the apparatus may be configured to calculate the injection finish timing R4 by calculating a timing before the crossing timing LBβ by a predetermined delay time Cβ.

According to the inventor's analysis, an inclination of the descent approximation straight-line Lα has high correlation with an inclination of increasing part of fuel injection which is shown by a line Rα on the waveform (b) in FIG. 2. The apparatus is designed based on the analysis, and calculates an inclination of the line Rα based on the descent approximation straight-line Lα. For example, the inclination of the line Rα may be calculated by multiplying an inclination of Lα by a predetermined coefficient Cα1. Similarly, an inclination of the ascent approximation straight-line Lβ has high correlation with an inclination of decreasing part of fuel injection which is shown by a line Rβ on the waveform (b) in FIG. 2. The apparatus is designed based on the analysis, and calculates an inclination of the line Rβ by multiplying an inclination of the ascent approximation straight-line Lβ by a predetermined coefficient Cβ2.

Then, the apparatus calculates a valve closure start timing R23 where the valve member 12 begins downward movement in response to the trailing edge of the injection command signal. In detail, the apparatus calculates a crossing point of the lines Rα and Rβ, and calculates a crossing timing of the lines Rα and Rβ as the valve closure start timing R23. The apparatus calculates injection delays, such as an injection start delay time td and an injection finish delay time te. The injection start delay time may be calculated as a delay time of the injection start timing R1 with respect to the start timing t1 of the injection command signal. The injection finish delay time te may be calculated as a delay time of the valve closure start timing R23 with respect to the finish timing t2 of the injection command signal.

The apparatus calculates a crossing pressure Pαβ (P-Alpha-Beta) which is shown by a pressure corresponding to a crossing of the descent approximation straight-line Lα and the ascent approximation straight-line Lβ. The apparatus calculates a pressure difference ΔPγ (Delta-P-Gamma) between the standard pressure Pbase and the crossing pressure Pαβ. This calculation is explained later. The pressure difference ΔPγ and the maximum injection rate Rmax has high correlation. The apparatus uses this characteristic and calculates the maximum injection rate Rmax based on the pressure difference ΔPγ.

The maximum injection rate Rmax may be calculated by multiplying the pressure difference ΔPγ by a correlation coefficient Cγ. In detail, the apparatus uses an expression Rmax=ΔPγ×Cγ to obtain the maximum injection rate Rmax in case of a small amount injection in which the pressure difference ΔPγ is less than a predetermined amount ΔPγth (ΔPγ<ΔPγth). On the other hand, the apparatus uses a predetermined value, such as a preset value Rγ, as the maximum injection rate Rmax in case of a large amount injection in which the pressure difference ΔPγ is equal to or greater than a predetermined amount ΔPγth (ΔPγ>=ΔPγth). The apparatus calculates an average fuel pressure of a standard waveform as a standard pressure Pbase. The standard waveform is a part of the fuel pressure waveform corresponding to a period until the fuel pressure starts dropping in response to a beginning of injection.

An injection in which the valve member 12 starts downward movement before an injection rate reaches to the maximum injection rate is assumed to be the small amount injection. In the small amount injection, an injection rate waveform becomes a triangle shape as shown by a broken line in a waveform (b) in FIG. 2. On the other hand, an injection in which the period Tq is long enough to keep opening condition after the injection rate reaches to the maximum injection rate is assumed to be the large amount injection. In the large amount injection, an injection rate waveform becomes a trapezoid shape as shown by a solid line in a waveform (b) in FIG. 2.

The preset value Rγ is prepared to simulate the maximum injection rate Rmax for the large amount injection. The preset value Rγ shall be changed with aging of the injector 10. For example, accumulation of foreign substances, such as a deposit, on the nozzle hole 11*b* may decrease a fuel injection amount and progresses an aging deterioration of the injector 10. In such the case, a pressure drop amount ΔP shown in a waveform (c) in FIG. 2 is gradually decreased. The pressure drop amount ΔP is an amount of descent of a detected pressure caused by an increase of injection rate. The pressure drop amount ΔP may correspond to an amount of pressure drop from the standard pressure Pbase to the inflection point P2, or an amount of pressure drop from the inflection point P1 to the inflection point P2.

The maximum injection rate Rmax in the large amount injection, i.e., the preset value Rγ, has high correlation with the pressure drop amount ΔP. The apparatus calculates and learns the preset value Rγ based on a detected result of the pressure drop amount ΔP. That is, a learnt value of the maximum injection rate Rmax in the large amount injection corresponds to a learnt value of the preset value Rγ which is learnt based on the pressure drop amount ΔP.

As described above, the injection rate parameters td, te, Rα, Rβ, and Rmax can be calculated from the pressure waveforms. In addition, it is possible to calculate the injection rate waveform (b) in FIG. 2 corresponding to the injection command signal (a) in FIG. 2 based on the learnt values of the injection rate parameters td, te, Rα, Rβ, and Rmax. Since an area of the injection rate waveform calculated in this way, shown by dots on the waveform (b) in FIG. 2, is equivalent to a fuel injection amount. Therefore, it is also possible to calculate a fuel injection amount based on the injection rate parameters.

Figure 3:
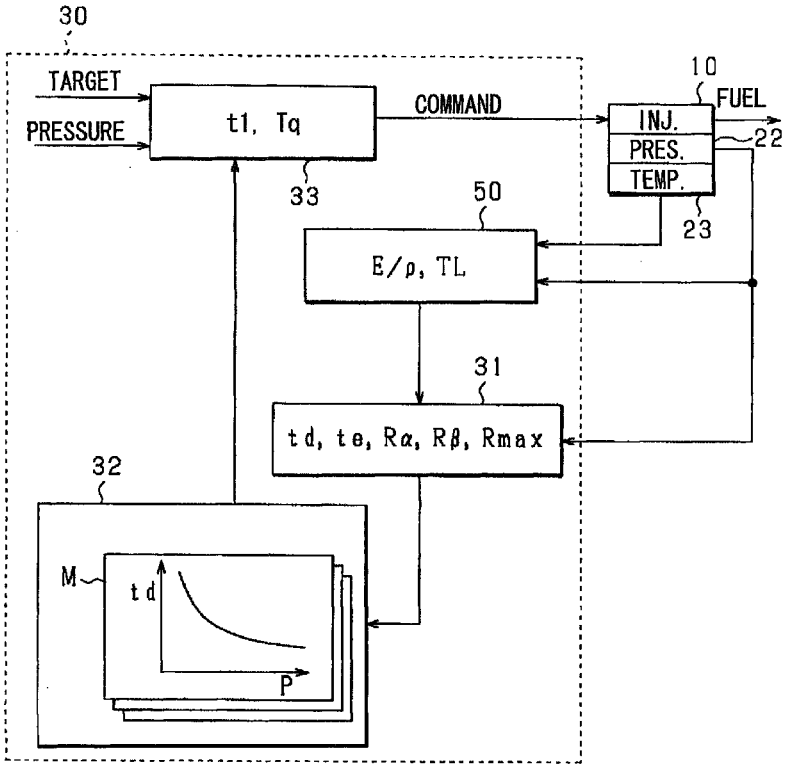
FIG. 3 is a diagram showing a control module for learning injection rate parameters and for setting injection command signal.

FIG. 3 is a block diagram showing outlines, such as setting of the injection command signal to the injectors 10, and learning of the injection rate parameters. The ECU 30, i.e., the apparatus, provides a plurality of sections 31, 32, 33, and 34 which performs predetermined function by a computer and computer readable program stored in a memory device. The injection rate parameter calculation section 31 calculates the injection rate parameters td, te, Rα, Rβ, and Rmax based on the fuel pressure waveforms detected by the fuel pressure sensor 22.

If at least one aspect of fuel state, such as a fuel property and a fuel temperature, changes, a correlation between a pressure waveform and an injection rate waveform, i.e., injection state, will changed. In detail, the predetermined delay time Cα, Cβ, the coefficient Cα1, cβ2, and the correlation coefficient of Cγ are changed in response to the changing of fuel state. In order to compensate such changing of variables, the estimation apparatus 50 estimates the fuel property and the fuel temperature based on the fuel pressure detected by the fuel pressure sensor 22, and the fuel temperature detected by the fuel temperature sensor 23. Then, the injection rate parameter calculation section 31 calculates the injection rate parameter, after correcting the variables such as Cα, Cβ, Cα1, Cα2, and Cγ based on the fuel property and the fuel temperature which are estimated by the estimation apparatus 50.

A learning section 32 learns the injection rate parameter by storing the injection rate parameters in a memory of the ECU 30 in an overwriting manner. The injection rate parameter takes different values according to a fuel pressure supplied, a fuel pressure in the common rail 42, at a time of calculation. Therefore, it is desirable to learn the injection rate parameter relate associated with the fuel pressure supplied or the standard pressure Pbase. The standard pressure Pbase is shown in (c) in FIG. 2. In the example shown in FIG. 3, the injection rate parameter associated with the fuel pressure supplied is stored in an injection rate parameter map M.

A setting section 33 acquires the injection rate parameter, i.e., the learnt value, corresponding to a present fuel pressure from the injection rate parameter map M. The setting section 33 may be referred to as a control section. The setting section 33 calculates and outputs the injection command signal defined by at least the start timing t1 and the injection period Tq based on the target injection state, the fuel pressure, and the learnt value of the injection rate parameter. The setting section 33 sets the injection command signal defined by t1, t2, and Tq corresponding to the target injection state based on the acquired injection rate parameter. The ECU 30 operates the injector 10 according to the injection command signal. The ECU 30 detects the fuel pressure waveform caused by the operation of the injector 10 by the fuel pressure sensor 22. Then, the ECU 30 again learns the injection rate parameters td, te, Rα, Rβ, and Rmax. The injection rate parameters td, te, Rα, Rβ, and Rmax are calculated by the injection rate parameter calculation section 31 based on the fuel pressure waveforms.

That is, the apparatus detects and learns an actual injection state caused by an injection command signal in the past, and sets and adjusts the injection command signal in the future based on the learnt values in order to achieve the target injection state. The injection command signal is set and adjusted by a feedback control method based on the actual injection state. Therefore, even if aging deterioration progresses, it is possible to control the fuel injection state with high accuracy so that the actual injection state approaches to the target injection state. In this embodiment, a feedback control for the injection command signal is performed to adjust the period Tq based on the injection rate parameters so that the actual fuel injection amount approaches to and equal to a target fuel injection amount. In other words, the apparatus compensates the injection command signal to adjust the actual fuel injection amount to the target fuel injection amount.

In the following description, a cylinder to which fuel is injected from an injector 10 is referred to as an injected cylinder or an active cylinder. A cylinder to which no fuel is injected is referred to as a non-injected cylinder or an inactive cylinder. The non-injected cylinder is not supplied with fuel when the injected cylinder is supplied with fuel. A fuel pressure sensor 22 corresponding to the injected cylinder may be referred to as an injected pressure sensor. A fuel pressure sensor 22 corresponding to the non-injected cylinder may be referred to as a non-injected pressure sensor. In addition, the injected pressure sensor corresponds to a first fuel pressure sensor. The non-injected pressure sensor corresponds to a second fuel pressure sensor. The injector 10 for the injected cylinder corresponds to a first injector. The injector 10 for the non-injected cylinder corresponds to a second injector.

Figure 4:
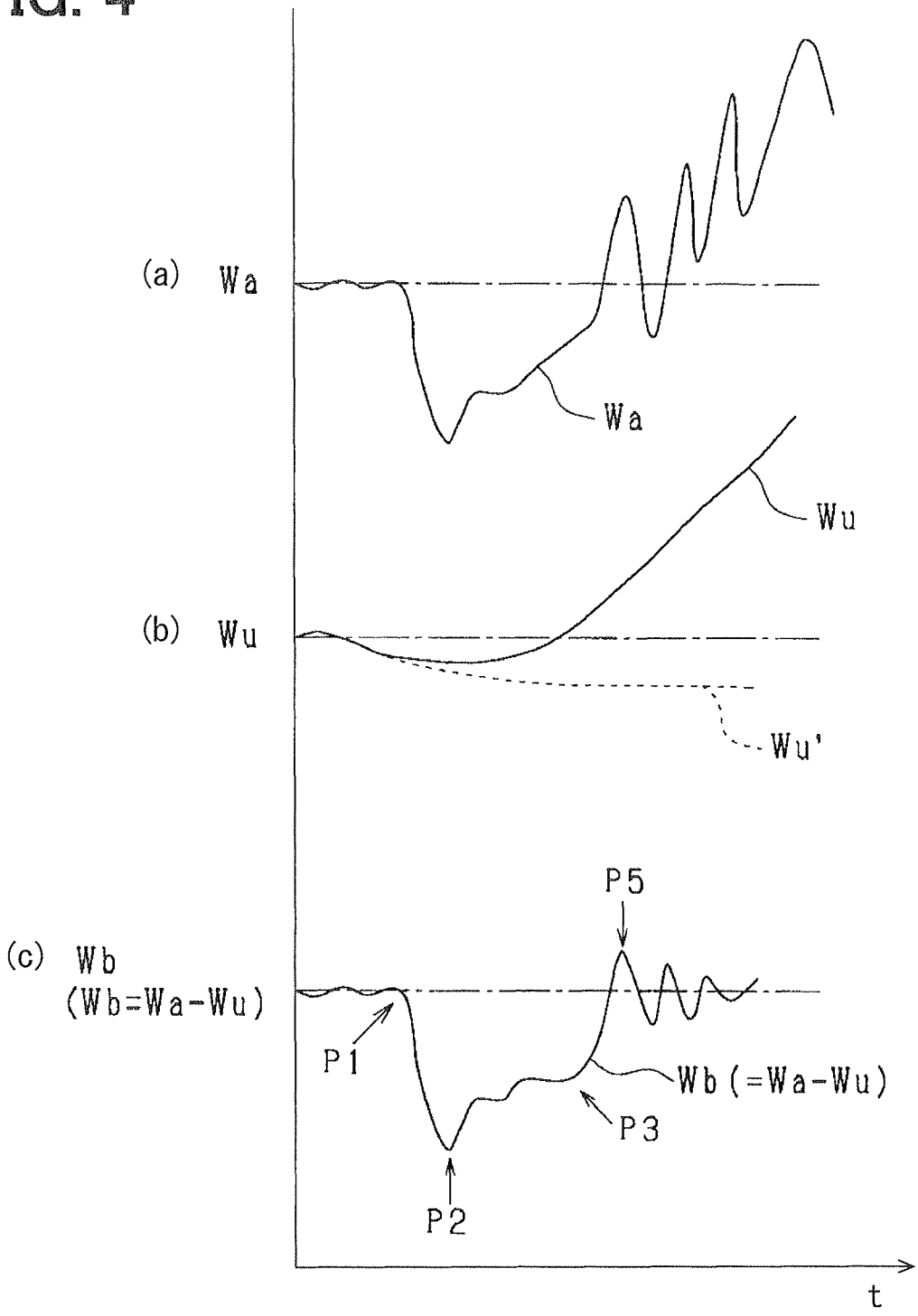
FIG. 4 is a timing diagram showing waveforms of fuel pressure.

In FIG. 4, a waveform (a) shows a composite waveform Wa, waveforms (b) show background waveforms Wu and Wu', and a waveform (c) shows an injection waveform Wb. The composite waveform Wa may be referred to as an injected cylinder waveform. The background waveform Wu and Wu' may be referred to as a non-injected cylinder waveform. The composite waveform Wa is a pressure waveform detected by a fuel pressure sensor provided for a cylinder to which fuel injection is performed. The composite waveform Wa includes not only components caused by influences of an injection but also components caused by the other influences other than the injection. The other influences may include the following examples. For example, the composite waveform Wa may reflect an operation of the fuel pump 41. The system may include the fuel pump 41 which pressurizes and feeds fuel in the fuel tank 40 to the common rail 42 and intermittently pressurizes fuel by using a mechanism like a plunger pump. In this case, if pumping is performed during fuel injection, the composite waveform Wa in the pumping period may show higher pressure. In other words, the composite waveform Wa includes at least a component corresponding to the injection waveform Wb showing pressure change purely caused by an injection and a component corresponding to the background waveform Wu showing pressure increase caused by a pumping operation of the fuel pump 41.

If the pumping operation is not performed during an injection, fuel pressure in the injection system drops by an amount of injected fuel in a period just after the fuel injection. Therefore, the composite waveform Wa in an injection period shows a waveform that is relatively low for the injection period. In other words, the composite waveform Wa includes a component corresponding to the injection waveform Wb showing pressure change purely caused by an injection and a component corresponding to a background waveform Wu showing pressure drop caused by no pumping operation of the fuel pump.

The background waveform Wu and the background waveform Wu' may be observed and detected in a period when no injection is performed. In other words, the background waveform Wu and the background waveform Wu' may be detected by the pressure sensor disposed on a cylinder for which no injection is performed. The background waveform Wu and Wu' show pressure change in the common rail, i.e., pressure change of whole system. Therefore, it is possible to calculate the injection waveform Wb by subtracting the background waveform Wu (Wu') from the composite waveform Wa. Such processing may be referred to as background cancel processing. The background waveform Wu (Wu') is detected by the pressure sensor 22 for the non-injected cylinder. The composite waveform Wa is detected by the pressure sensor 22 for the injected cylinder. Therefore, the apparatus extracts a branch waveform component from the pressure waveform obtained by subtracting the non-injected cylinder waveform Wu (Wu') from the injected cylinder waveform Wa. The non-injected cylinder waveform Wu (Wu') is detected by the second fuel pressure sensor when the first injector injects fuel. The injected cylinder waveform Wa is detected by the first fuel pressure sensor when the first injector injects fuel. The waveform of fuel pressure shown in FIG. 2 is the injection waveform Wb.

In a case that a multi-stage injection is performed, a leading stage injection causes pulsations after the leading stage injection. In some cases, such pulsations shall be considered to calculate the injection waveform Wb. In FIG. 2, a pulsation waveform Wc, which shows pulsations caused by a leading stage injection, is superposed on the composite waveform Wa. Especially, in a case that an interval between a leading stage injection and a trailing stage injection is short, the composite waveform Wa is greatly affected by the pulsation waveform Wc. Therefore, it is desirable to calculate the injection waveform Wb by performing a surge cancel processing. In the surge cancel processing, the pulsation waveform Wc is subtracted from the composite waveform Wa. When performing both the background cancel processing and the surge cancel processing, both the non-injected cylinder waveform Wu (Wu') and the pulsation waveform Wc are subtracted from the composite waveform Wa.

Figure 5:
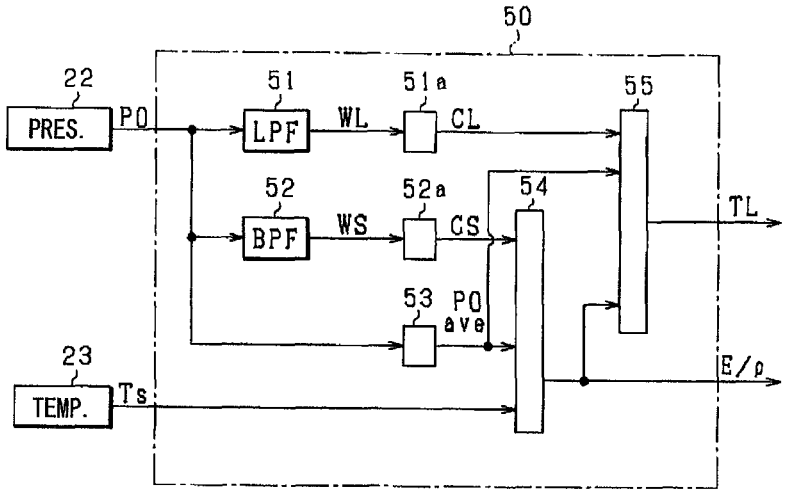
FIG. 5 is a block diagram showing a fuel state estimation apparatus shown in FIG. 3.

Referring to FIG. 5, the fuel state estimation apparatus 50 is explained in detail. The estimation apparatus 50 is provided by the ECU 30, and is provided by various components such as input processing circuits, output processing circuits, and a microcomputer, etc. FIG. 5 shows a functional block diagram of the estimation apparatus 50.

The estimation apparatus 50 acquires and inputs a pressure waveform P0 of fuel detected by the fuel pressure sensor 22. The ECU 30 functions as a pressure waveform acquisition section to acquire the pressure waveform P0. It is desirable that the pressure waveform P0 acquired here is the injection waveform Wb, shown in (c) of FIG. 4. The injection waveform Wb is obtained by performing the background cancel processing and the surge cancel processing. The background cancel processing may be performed by subtracting the non-injected cylinder waveform Wu from the composite waveform Wa. The surge cancel processing may be performed by subtracting the pulsation waveform Wc from the composite waveform Wa. In addition, it is more desirable that the ECU 30 acquires a part of the pressure waveform P0 in a predetermined period. The predetermined period corresponds to a period immediately after completing a pressure increase in response to a finishing of fuel injection. In other words, the predetermined period corresponds to a period after the inflection point P5. For example, it is possible to use the pulsation waveform Wc, shown in (c) of FIG. 2, which is used in the surge cancel processing, as the pressure waveform P0.

Figure 6:
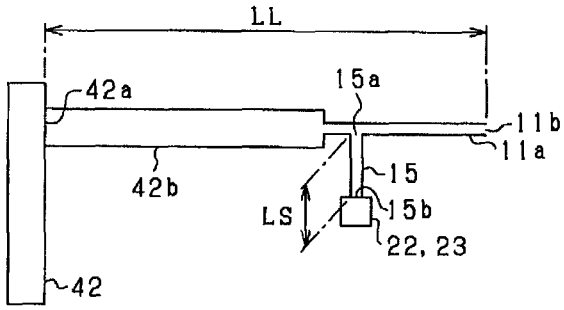
FIG. 6 is a diagram showing a model of a main passage and a branch passage in FIG. 1.
Figure 7:
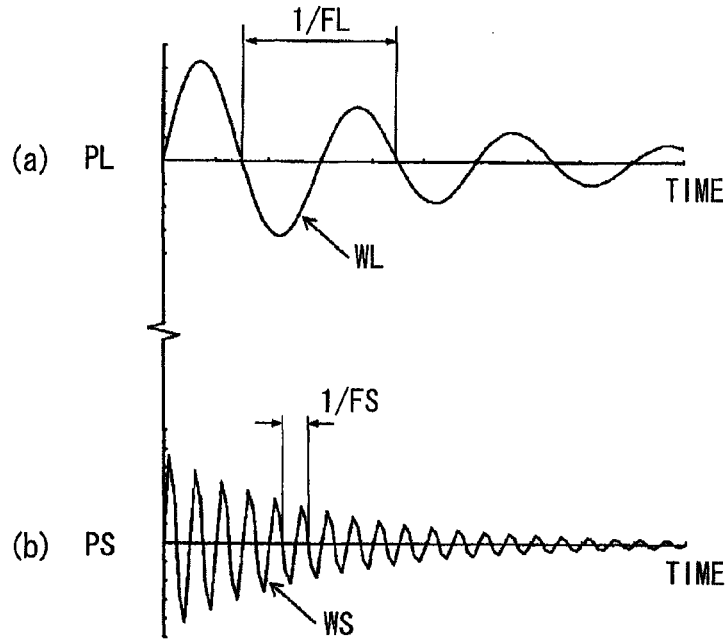
FIG. 7 is a diagram showing a main waveform component WL and a branch waveform component WS which were extracted by a filter shown in FIG. 5.

FIG. 6 shows a model of passages from the outlet 42*a* of the common rail 42 to the nozzle hole 11*b* of the injector 10. The passages include the main passage 11*a*, 42*b*, and the branch passage 15. The main passage is provided by the high pressure passage 11*a* formed within the injector 10 and a passage defined in the high pressure pipe 42*b* which connects the injector 10 and the pressure accumulation container 42. The diameter of the passage in the high pressure pipe 42*b* is larger than the diameter of the high pressure passage 11*a*.

Among passages in FIG. 1, the nozzle hole 11*b*, the branch opening 15*a*, and the outlet 42*a* are portions through which pressure wave cannot pass easily. Pressure wave makes reflection at these portions. Therefore, the main waveform component WL becomes a waveform which oscillates and vibrates with an oscillating cycle CycleL, i.e., CycleL=1/Frequency FL, which depends on a structure of the main passage, such as a passage length LL of the main passage, and a passage volume of the main passage. The branch waveform component WS becomes a waveform which oscillates and vibrates with an oscillating cycle CycleS, i.e., CycleS=1/Frequency FS, which depends on a structure of the branch passage 15, such as a passage length LS of the branch passage, and a passage volume of the branch passage. The frequency FL varies in response to changing of at least one of a fuel temperature and a fuel property therein. The frequency FS varies in response to changing of at least one of a fuel temperature and a fuel property therein.

In addition, the pressure wave may create reflections on portions, such as a connection between the high pressure pipe 42*b* and the injector 10, besides the nozzle hole 11*b*, the branch opening 15*a*, and the outlet 42*a*. Therefore, various waveform components other than the main waveform component WL and branch waveform component WS are generates in the passage. The main waveform component WL and branch waveform component WS can be considered as major components.

Through the branch opening 15*a*, vibrating force from the main waveform component WL is applied to the fuel in the branch passage 15 which is made as a dead end passage. As a result, the fuel in the branch passage 15 oscillates and vibrates in a waveform on which the branch waveform component WS and the main waveform component WL are superimposed. Therefore, the pressure waveform P0 acquired will contain both the branch waveform component WS and main waveform component WL.

Returning to FIG. 5, the estimation apparatus 50 has a low-pass filter 51 and a band-pass filter 52. The low-pass filter 51 provides a main extraction section which extracts the main waveform component WL from the acquired pressure waveform P0. The band-pass filter 52 provides a branch extraction section which extracts the branch waveform component WS from the acquired pressure waveform P0. The filters 51 and 52 are digital filters. The filters 51 and 52 extracts the components WL and WS from digital signal converted from the pressure waveform P0.

Figure 8:
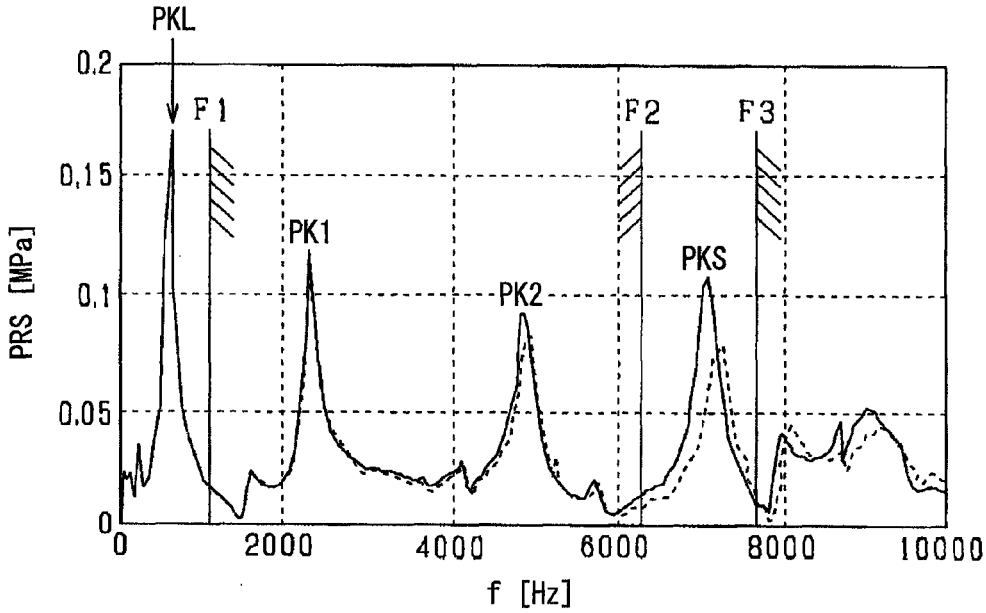
FIG. 8 is a graph showing a frequency distribution.

FIG. 8 shows an example of a frequency distribution of pressure strength PRS of on the fuel pressure waveform P0. Scale on the horizontal axis shows a frequency "f". A peak PKL resulting from the main waveform component WL may be observed in a frequency band that is not more than a symbol F1. A plurality of peaks PKS resulting from the branch waveform component WS may be observed within a frequency band defined between symbols F2 and F3. Therefore, a filtering frequency of the low-pass filter 51 may be set at a frequency F1, e.g., 1000 Hz, which can be obtained by experimental works. A filtering frequency band of the band-pass filter 52 may be set at a frequency band between F2 and F3, e.g., 6000 Hz-7500 Hz, which can be obtained by the experimental works.

The frequency of the main waveform component WL is considered as a basic frequency of vibrations produced in the main passage. There may be several components of higher order waves. In FIG. 8, peaks PK1 and PK2 are caused by the higher order waves.

Returning to FIG. 5, the estimation apparatus 50 has a main velocity calculation section 51*a* to calculate a main velocity CL based on the main waveform component WL extracted by the above processing. The main velocity CL is a velocity of pressure wave traveling in the main passage. For example, the estimation apparatus 50 calculates an oscillating cycle CycleL of the main waveform component WL extracted, and calculates a frequency FL from the oscillating cycle CycleL by using an expression: FL=1/CycleL. Then, the estimation apparatus 50 calculates the main velocity CL by multiplying the frequency FL by a predetermined coefficient KL. The coefficient KL may be determined based on the structure of the main passage 11*a* and 42*b*, such as the main passage length LL and a volume thereof.

The estimation apparatus 50 has a branch velocity calculation section 52*a* to calculate a branch velocity CS based on the branch waveform component WS extracted by the above processing. The branch velocity CS is a velocity of pressure wave traveling in the branch passage. For example, the estimation apparatus 50 calculates an oscillating cycle CycleS of the branch waveform component WS extracted, and calculates a frequency FS from the oscillating cycle CycleS by using an expression: FS=1/CycleS. Then, the estimation apparatus 50 calculates the branch velocity CS by multiplying the frequency FS by a predetermined coefficient KS. The coefficient KS may be determined based on the structure of the branch passage 15, such as the branch passage length LS and a volume thereof.

The estimation apparatus 50 has an average pressure calculation section 53 which calculates an average pressure P0ave based on the pressure waveform P0 acquired. For example, the average pressure P0ave may be obtained by an average value of a plurality of sampling values of pressure that define the pressure waveform P0.

The downstream side body inserted in the cylinder head E1 receives heat from the engine, such as the cylinder head E1 and the combustion chamber, and becomes high temperature. Contrary, the upstream side body located on an outside of the cylinder head E1 and defining the branch passage 15 can be kept cool compared with the downstream side body. Therefore, the fuel in the branch passage 15 is cooler than the fuel in the passage in the downstream side body. In addition, since the branch passage 15 is formed in a dead end shape, only a small quantity of fuel may be entered into the branch passage 15 from the high pressure passage 11*a*. Therefore, the fuel in the branch passage and the fuel in the high pressure passage can get a large difference in temperature. A fuel temperature in the main passage 11*a* is referred to as a main temperature TL. A fuel temperature in the branch passage 15 is referred to as a branch temperature TS.

Figure 9A:
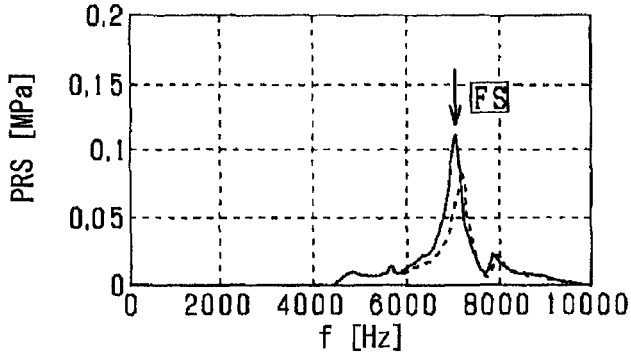
FIGS. 9A and 9B are graphs showing frequency distributions.
Figure 9B:
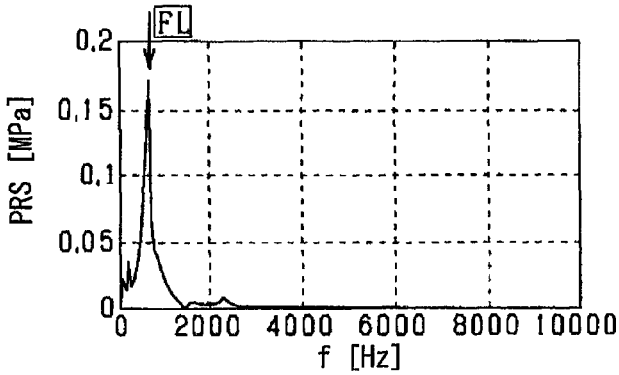

FIGS. 9A and 9B are examples of frequency distribution of strength, i.e., pressure, corresponding to the branch waveform components WS and the main waveform components WL, respectively, extracted by the filters 51 and 52. Solid lines in FIG. 8 and FIGS. 9A and 9B show results of experimental works, which are performed while assuming a large difference between temperatures TL and TS. In the experimental works, the branch temperature TS, e.g., 70 Celsius degrees is kept higher than the main temperature TL, e.g., 30 Celsius degrees. Broken lines in FIG. 8 and FIGS. 9A and 9B show a result of experimental works in which the branch temperature TS and the main temperature TL are kept at the same degrees, e.g., 30 Celsius degrees.

As shown in drawings, when the main temperature TL is increased from 30 Celsius degrees to 70 Celsius degrees, although a frequency band of a peak PKS resulting from the branch waveform component WS changes, a frequency band of a peak PKL resulting from the main waveform component WL does not change.

Figure 10A:
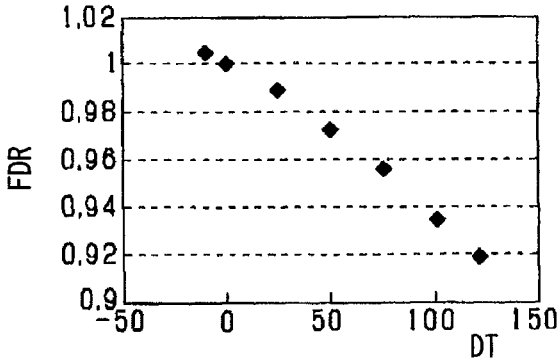
FIGS. 10A and 10B are graphs showing frequency deviation depending on temperature deviation.
Figure 10B:
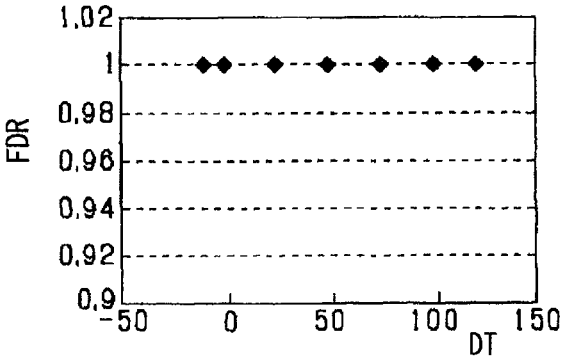

FIGS. 10A and 10B support the above view. FIGS. 10A and 10B show results of experimental works in which the branch temperature TS is varied from a standard temperature 70 Celsius degrees, while the main temperature TL is maintained at a constant temperature 30 Celsius degrees. In FIGS. 10A and 10B, scales on the horizontal axis show a temperature deviation DT from the standard temperature of the branch temperature TS. Scales on the vertical axis show a frequency deviation rate FDR of peaks appearing on the range between 6000 Hz and 7000 Hz in FIG. 8. The frequency deviation rate FDR is calculated based on a frequency of a peak appearing on the range when the branch temperature TS is at the standard temperature 70 Celsius degrees. According to the drawings, it may be confirmed that if the main temperature TL is changed, the frequency of the peak PKS resulting from the branch waveform component WS shifts, but the frequency band of the peak PKL resulting from the main waveform component WL does not shift.

In addition, it is desirable to set up the filtering frequency band of the band-pass filter 52 based on results of previous experimental works of FIG. 10 so that the frequency bands F2-F3 cover a frequency range in which a frequency of the peak PKS may be shifted in response to the branch waveform component WS.

Returning to FIG. 5, the estimation apparatus 50 has a fuel property estimation section 54 which calculates and estimates a fuel property. The fuel property estimation section 54 calculates the fuel property by using the map shown in FIG. 11 based on the branch velocity CS, the average pressure P0ave, and the branch temperature TS which is a detected value of the fuel temperature sensor 23.

Figure 11:
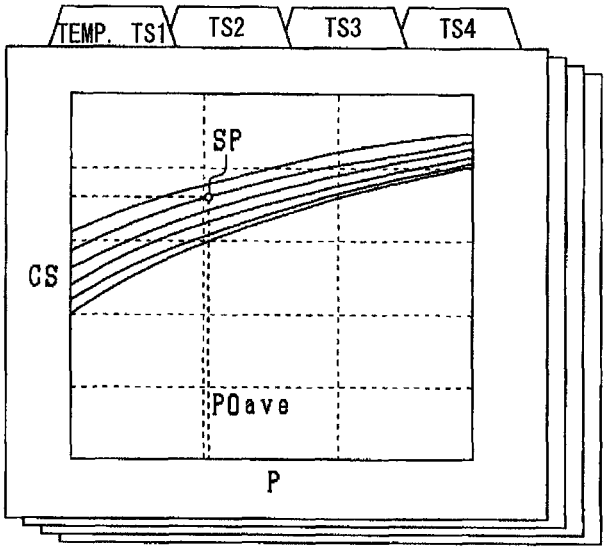
FIG. 11 is a diagram showing maps used for estimating a fuel, property.

Solid lines in FIG. 11 show characteristic lines which show relationships between the average pressure P0ave and the branch velocity CS. Each characteristic line reflects a fuel property and a fuel temperature. In FIG. 11, a plurality of characteristic lines showing difference among fuel properties are illustrated. Those characteristic lines are prepared for some representative fuel temperatures, such as TS1, TS2, TS3, and TS4. In this embodiment, characteristic lines in each temperature provide a map for identifying a fuel property.

The property estimation section 54 selects one map from the maps based on the detected temperature TS from the temperature sensor 23. Then, the property estimation section 54 calculates a crossing point SP of the branch velocity CS and the average pressure P0ave in the selected map, and selects one characteristic line that is nearest to the crossing point SP from the characteristic lines. The selected characteristic line shows a kind of fuel, i.e., the fuel property that is actually used in the system. Therefore, the property estimation section 54 can identify the fuel property based on the selected characteristic line.

The bulk modulus E and the density ρ (Rho) of fuel may be identified by a kind of fuel. In this embodiment, a ratio E/ρ (E/Rho) is used as a value for expressing fuel property quantitatively.

Returning to FIG. 5, the estimation apparatus 50 has a main temperature estimation section 55 to calculate and estimate the main temperature TL. The main temperature estimation section 55 estimates the main fuel temperature TL in the main passage based on the branch fuel temperature TS, the branch velocity CS, the main velocity CL, and the average pressure P0ave. In detail, the main temperature estimation section 55 calculates the main temperature TL by using maps shown in FIG. 12 based on the main velocity CL and the average pressure P0ave, and a fuel property E/ρ determined by the property estimation section 54.

Figure 12:
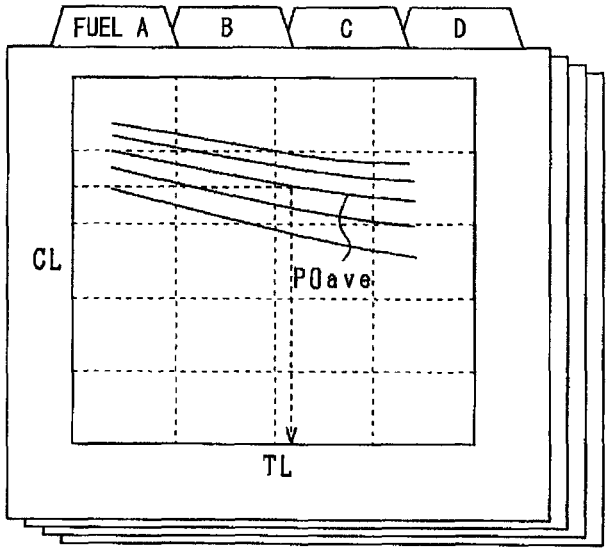
FIG. 12 is a diagram showing maps used for calculating a temperature TL in a high pressure passage.

Solid lines in FIG. 12 show characteristic lines which show relationships between the main temperature TL and the main velocity CL. Each characteristic line reflects the average pressure P0ave and the fuel property E/ρ. In FIG. 12, a plurality of characteristic lines showing difference among fuel properties are illustrated. Those characteristic lines are prepared for some representative kinds of fuel, such as "A", "B", "C", and "D". Characteristic lines shifts upwardly as the pressure increases.

The main temperature estimation section 55 selects one map from the maps based on the fuel property E/ρ identified by the above processing. The main temperature estimation section 55 selects one characteristic line corresponding to the average pressure P0ave from the characteristic lines stored in the selected map. The main temperature estimation section 55 determines a temperature corresponding to the main velocity CL on the selected characteristic line as the main temperature TL.

As described above, the estimation apparatus 50 has a fuel state estimation section provided by the sections 54 and 55. The section estimates the fuel property E/ρ and the main fuel temperature TL as the fuel state. The section performs the estimating calculation based on the pressure waveform P0. In detail, the sections performs the estimating calculation based on the branch fuel temperature TS, the branch velocity CS, the main velocity CL, and the average pressure P0ave. The fuel state estimation section estimates the main fuel temperature TL based on the branch fuel temperature TS, the branch velocity CS, the main velocity CL, and the average pressure P0ave. The fuel state estimation section includes a fuel property estimation section 54 which estimates a fuel property E/ρ based on the branch fuel temperature TS, the branch velocity CS, and the average pressure P0ave, and a main temperature estimation section 55 which estimates the main fuel temperature TL based on the fuel property E/ρ estimated by the fuel property estimation section, the main velocity CL and the average pressure P0ave. The fuel state estimation section may estimate only the fuel property E/ρ based on the branch fuel temperature TS, the branch velocity CS, and the average pressure P0ave.

Figure 13:
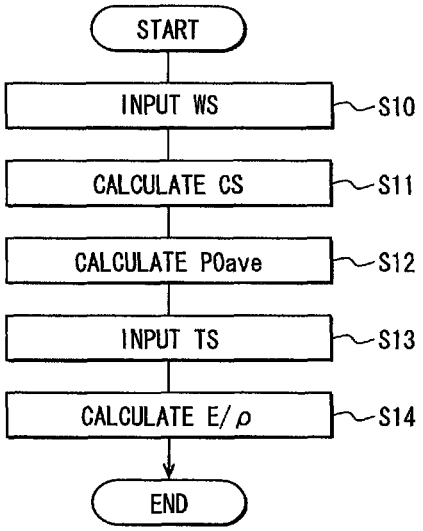
FIG. 13 is a flow chart for calculating a fuel property.

FIG. 13 is a flow chart which is carried out by a microcomputer in the ECU 30 and which shows estimating procedure of a fuel property. The processing is repeatedly performed with a predetermined interval.

In a step S10, the branch waveform component WS is acquired from the band-pass filter 52. In a step S11, processing of the branch velocity calculation section 52*a* is carried out. That is, the branch velocity CS is calculated from the branch waveform component WS acquired. In a step S12, processing of the average pressure calculation section 53 is carried out. That is, the average pressure P0ave is calculated from the pressure waveform P0. In a step S13, the branch temperature TS is acquired from a value detected by the fuel temperature sensor 23. In a step S14, processing of the fuel property estimation section 54 is carried out. That is, the fuel property E/ρ is calculated based on the branch velocity CS, the average pressure P0ave, and the branch temperature TS.

Figure 14:
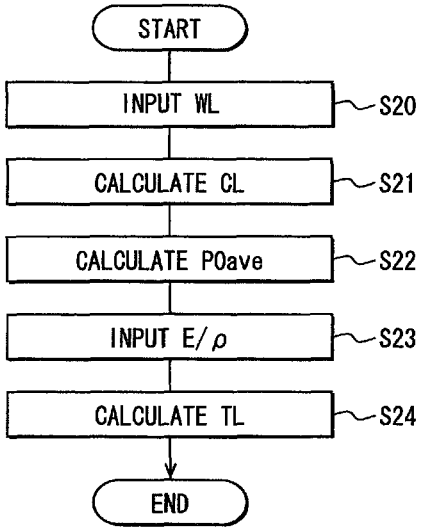
FIG. 14 is a flow chart for calculating a temperature TL in a high pressure passage.

FIG. 14 is a flow chart which is carried out by the microcomputer in the ECU 30 and which shows estimating procedure for the main temperature TS. The processing is repeatedly performed with a predetermined interval.

First, in a step S20, the main waveform component WL is acquired from the low-pass filter 51. In a step S21, processing of the main velocity calculation section 51*a* is carried out. That is, the main velocity CL is calculated from the main waveform component WL acquired. In a step S22, processing of the average pressure calculation section 53 is carried out. That is, the average pressure P0ave is calculated from the pressure waveform P0. In a step S23, the fuel property E/ρ obtained by processing of FIG. 13 is acquired. In a step S24, processing of the main temperature estimation section 55 is carried out. That is, the main temperature TL is calculated based on the main velocity CL, the average pressure P0ave, and the fuel property E/ρ.

Then, the ECU 30 corrects the variables, such as Cα, Cβ, Cα1, Cβ2, and Cγ, based on the fuel property E/ρ and the main temperature TL, which are estimated by the estimation apparatus 50, and then, the ECU 30 calculates the injection rate parameter based on the variables and injection waveform Wb. Therefore, it is possible to calculate the injection rate parameter properly even if a fuel that has a fuel property different from an expected fuel property. It is possible to calculate the injection rate parameter accurately even if the main temperature TL is different from a temperature detected by the fuel temperature sensor 23. As a result, it is possible to calculate the injection rate parameter accurately and control the injector 10 to achieve a desired injection.

In addition, the fuel property E/p and the main temperature TL are estimated based on signals detected by the fuel pressure sensor 22 and the fuel temperature sensor 23. In detail, the branch waveform component WS and the main waveform component WL are extracted from the pressure waveform P0 acquired from the signal detected by the fuel pressure sensor 22. The branch velocity CS and the main velocity CL are calculated from these waveform components WS and WL. Then, the fuel property E/ρ and the main temperature TL are estimated based on the velocities CS and CL, the branch temperature TS detected by the fuel temperature sensor 23, and the average pressure P0ave of the pressure waveform P0. Therefore, the variables, such as the fuel property E/ρ and the main temperature TL, to be used for correcting the correlation variables Cα, Cβ, Cα1, Cβ2, and Cγ may be acquired without additional sensors. It is possible to reduce the number of sensors and cost.

In addition, a pressure waveform in a period of time just after the timing P5 at which a pressure increase in response to a finishing of fuel injection is completed is used as the pressure waveform P0 used for extraction of the branch waveform component WS and the main waveform component WL. Therefore, it is possible to calculate the main velocity CL and the branch velocity CS accurately.

In addition, a pressure waveform processed by the background cancel processing and/or the surge cancel processing is used as the pressure waveform P0 used for extraction of the branch waveform component WS and the main waveform component WL. Therefore, it is possible to calculate the main velocity CL and the branch velocity CS accurately.

(Second Embodiment)

Figure 15:
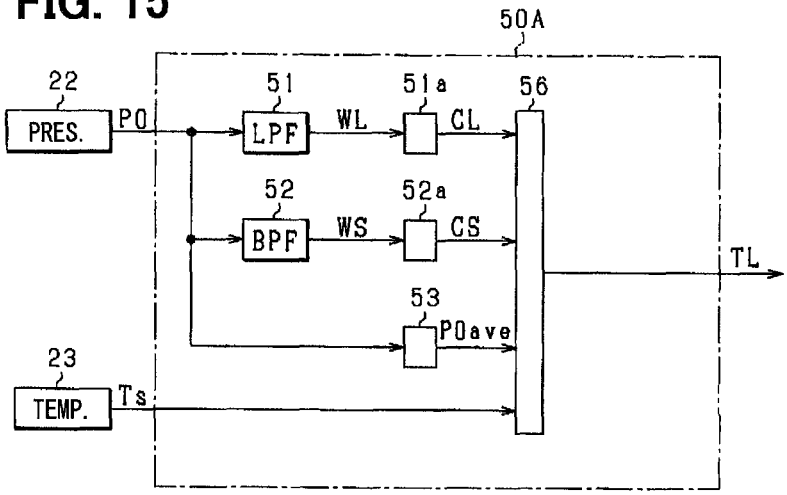
FIG. 15 is a block diagram showing a fuel state estimation apparatus according to a second embodiment of the present disclosure.

In the estimation apparatus 50 in the first embodiment, the main temperature estimation section 55 calculates the main temperature TL by using the fuel property E/ρ calculated by the fuel property estimation section 54. FIG. 15 is a block diagram showing a fuel state estimation apparatus according to a second embodiment of the present disclosure. In this embodiment, the fuel state estimation apparatus 50A does not have the fuel property estimation section 54.

In case of the estimation apparatus 50 in FIG. 5, the fuel property estimation section 54 calculates the fuel property E/ρ based on the parameters CS, P0ave, and TS. The main temperature estimation section 55 calculates the main temperature TL based on the parameters CL, P0ave, and E/ρ. This means that main temperature TL may be calculated based on the parameters CS, P0ave, TS, and CL.

In the main temperature estimation section 56 in the estimation apparatus 50A in FIG. 15, the main temperature TL is calculated based on the main velocity CL calculated by the main velocity calculation section 51*a*, the branch velocity CS calculated by the branch velocity calculation section 52*a*, the average pressure P0ave calculated by the average pressure calculation section 53, and the branch temperature TS detected by the fuel temperature sensor 23.

In addition, the variables E/ρ and TL are calculated by using the map shown in FIG. 11 and FIG. 12 in the first embodiment. Alternatively, an equation for calculating the variable TL based on the parameters CS, P0ave, TS, and CL may be stored in a memory device of the microcomputer in the ECU 30. In this case, the ECU 30 can calculate the variable TL by substituting the parameters CS, P0ave, TS, and CL in the stored equation. Further alternatively, a map which associates or links the variable TL and the parameters CS, P0ave, TS, CL, and TL may be stored in the memory device. The ECU 30 may determine the variable TL by using the map.

Then, the ECU 30 may corrects the correlation variables Cα, Cβ, Cα1, Cβ2, and Cγ based on the main temperature TL calculated. In this embodiment, the system may include a dedicated sensor for detecting the fuel property. In this case, the ECU 30 may correct the correlation variables Cα, Cβ, Cα1, Cβ2, and Cγ based on the fuel property detected by the sensor. In addition, the correction based on the fuel property may be eliminated if it is possible to assume that there is almost no possibility to fuel a different fuel that has fuel property largely different from an expected fuel property.

According to the embodiment, since the estimation apparatus 50A can estimate the main temperature TL while eliminating the fuel property estimation section 54, it is possible to reduce processing load.

(Third Embodiment)

Figure 16A:
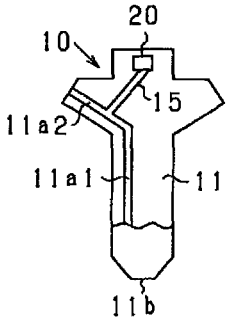
FIGS. 16A to 16D are diagrams showing various passage arrangements in injectors.

FIGS. 16A to 16D are diagrams showing various passage arrangements in injectors. FIG. 16A shows a simplified model of the injector 10 shown in FIG. 1. The estimation apparatus 50, 50A described above may be combined with the injectors 10B, 10C, and 10D shown in FIGS. 16B, 16C, and 16D. Hereafter, the injectors 10B, 10C, and 10D are explained while focusing on the difference from the injector 10.

In FIG. 16A, the high pressure passage 11*a* is formed by a first passage 11*a*1 and a second passage 11*a*2. The first passage 11*a*1 has a shape that extends in an axial direction of the body 11 formed in a columnar shape. The second passage 11*a*2 has a, shape that extends obliquely and crosses the first passage 11*a*1. The branch passage 15 has a shape that is branched and prolonged from the first passage 11*a*1.

Figure 16B:
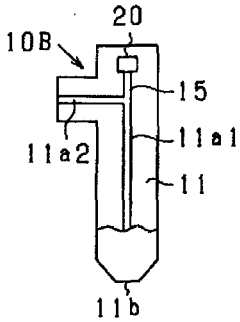
Figure 16C:
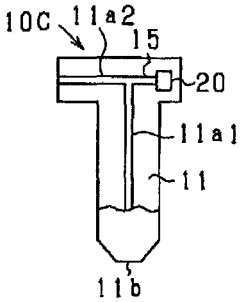
Figure 16D:
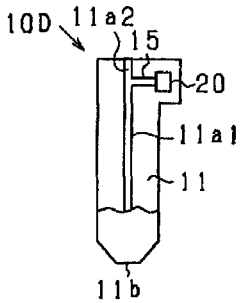

FIGS. 16B, 16C, and 16D show modified arrangement of the second passage 11*a*2 and the branch passage 15. In the injectors 10B and 10C shown in FIGS. 16B and 16C, the second passage 11*a*2 extends perpendicular to the first passage 11*a*1. The branch passages 15 are branched from a connection place between the first passage 11*a*1 and the second passage 11*a*2. In the injector 10B, the branch passage 15 is located on an extension of the first passage 11*a*1. In the injector 10C, the branch passage 15 is located on an extension of the second passage 11*a*2.

In the injector 10D, an inlet to be connected to the high pressure pipe 42*b* is located on a top end, which is opposite end to the nozzle hole. A high pressure passage is formed in a shape that extends in the axial direction of the body 11. That is, the second passage 11*a*2 is located on an extension of the first passage 11*a*1. The branch passage 15 is formed in a shape that extends in a radial direction of the body 11.

In these variants shown in FIGS. 16B, 16C, and 16D, the sensor unit 20 is mounted on the end of the branch passage 15. The estimation devices 50 and 50A may be combined with the injectors 10B, 10C, and 10D. Similarly, the estimation devices 50 and 50A may be combined with the other arrangement of injector in which at least the sensor unit 20 is mounted on the branch passage 15.

(Other Embodiments)

The present disclosure is not limited to the above-mentioned embodiments, but may be implemented by the following modification. In addition, the parts and components in the embodiments may be combined freely.

In the above-mentioned embodiments, the filtering frequency band, i.e., specific frequency band, of the band-pass filter 52 shown in FIG. 5 and FIG. 15 is fixed at a predetermined band which is defined based on the result of previous experimental works. Alternatively, the filtering frequency band may be set variable in accordance with at least one of the branch fuel temperature TS that is detected by the fuel temperature sensor 23 and the average pressure P0ave. Such a variable control of the band-pass filter may be performed in the band-pass filter 52 shown in FIGS. 5 and 15. In such a case, even if a frequency of the peak strength PKS is shifted in response to a change of a temperature or a pressure, since the branch waveform component WS is extracted by the filtering frequency band variable according to the shift, it is possible to improve extraction accuracy.

In the above-mentioned embodiments, estimating processing shown in FIG. 13 and FIG. 14 are performed cyclically in a predetermined interval when the engine is operated. Alternatively, the estimating processing may be performed by using a pressure waveform P0 acquired when an operational status of the internal combustion engine is in a predetermined operational status, e.g., an idling operation or a steady operation. In such a case, the pressure waveform P0 is acquired when the engine is kept in a specific condition, e.g., a temperature and a pressure may be kept at a presumable value, therefore, it is possible to adjust the filtering frequency band to a band corresponding to the presumable values. Therefore, it is possible to improve extraction accuracy of the branch component WS while eliminating variable setting of the filtering frequency band.

Although the fuel temperature changes a lot during an engine operating period, the fuel property does not change so often. The fuel property may be changed when new fuel is fueled in a tank. Therefore, it is desirable to reduce load for processing by setting an operation cycle of fuel property estimation processing by FIG. 13 longer than an operation cycle of temperature estimation processing by FIG. 14.

In the embodiment, the injector 10 has the sensor unit 20 located outside of the cylinder head as shown in FIG. 1. In this arrangement, since the temperatures TS and TL may be largely differed, therefore, it is possible to provide a significant advantage by correcting the values Cα, Cβ, Cα1, Cβ2, and Cγ based on the temperature TL. However, the present disclosure may be applied to an injector 10 that has, a sensor unit located inside of the cylinder head.

In the embodiment shown in FIG. 1, the branch passage 15 is located in the upstream side portion of the body 11. However, the branch passage 15 may be located in the downstream side portion of the body 11.

In the embodiment shown in FIG. 1, both the fuel pressure sensor 22 and the fuel temperature sensor 23 are unitary formed and attached on a common member, i.e., the stem 21. The fuel temperature sensor 23 may be disposed on a different location other than the stem 21.

In the above embodiment, the branch waveform component WS and the main waveform component WL are extracted from the injection waveform Wb. Alternatively, at least one of the components WS and WL may be extracted from the composite waveform Wa, i.e., the injected cylinder waveform Wa.

In the above-mentioned embodiments, the extraction is performed on a part of the pressure waveform corresponding to a period immediately after completing a pressure increase in response to a finishing of fuel injection. Alternatively, the extraction may be performed on a pressure waveform in a period just before a timing P1 where a pressure dropping begins in response to a beginning of fuel injection.

In the above-mentioned embodiment shown in FIG. 1, the sensor unit 20 is mounted on the injector 10. Alternatively, it is possible to employ a structure in which a sensor unit is mounted on a branch pipe which is connected to the high pressure pipe 42*b*.

In the above-mentioned embodiments, the low-pass filter 51 and band-pass filter 52 are digital filters which extract components from a waveform converted in digital form. Instead of the filters 51 and 52, analog filters for extracting components from analog signal of waveform may be used.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, which are preferred, other combinations and configurations, including more, less or only a single element, are also within the spirit and scope of the present disclosure.

What is claimed is:

1. An apparatus of estimating fuel state being applied to a fuel injection system having an injector which injects fuel for combustion in an internal combustion engine;

a pressure accumulation container which contains pressurized fuel and supplies the pressurized fuel to the injector;

a fuel pressure sensor configured to detect a fuel pressure in a branch passage, which is branched from a main passage extending between an outlet of the pressure accumulation container and a nozzle hole of the injector; and a fuel temperature sensor configured to detect a branch fuel temperature in the branch passage, the apparatus comprising:

a main extraction section which extracts a main waveform component from a pressure waveform detected by the fuel pressure sensor, the main component being a component in the pressure waveform and caused by pressure vibration traveling in the main passage;

a branch extraction section which extracts a branch waveform component from the pressure waveform, the branch component being a component in the pressure waveform and caused by pressure vibration traveling in the branch passage;

a branch velocity calculation section which calculates a branch velocity, which is a velocity of pressure wave traveling in the branch passage, based on the branch waveform component;

a main velocity calculation section which calculates a main velocity, which is a velocity of pressure wave traveling in the main passage, based on the main waveform component;

an average pressure calculation section which calculates an average pressure of fuel supplied to the injector based on the pressure waveform; and a fuel state estimation section which estimates a main fuel state, which is fuel state relating to fuel in the main passage, based on the branch fuel temperature, the branch velocity, the main velocity, and the average pressure.

2. The apparatus of estimating fuel state in claim 1, wherein the fuel state estimation section estimates a main fuel temperature in the main passage.

3. The apparatus of estimating fuel state in claim 2, wherein the fuel state estimation section includes:

a fuel property estimation section which estimates a fuel property based on the branch fuel temperature, the branch velocity, and the average pressure; and a main temperature estimation section which estimates the main fuel temperature based on the fuel property estimated by the fuel property estimation section, the main velocity and the average pressure.

4. The apparatus of estimating fuel state in claim 1, wherein the fuel state estimation section estimates a fuel property.

5. The apparatus of estimating fuel state in claim 4, wherein the fuel state estimation section includes a fuel property estimation section which estimates the fuel property based on the branch fuel temperature, the branch velocity, and the average pressure.

6. The apparatus of estimating fuel state in claim 1, wherein the injector has a downstream side body in which a part of the main passage and the nozzle hole are formed and an upstream side body in which the branch passage is formed, and wherein the downstream side body is configured to be inserted in a cylinder head of the internal combustion engine, while the upstream side body is configured to be located on an outside of the cylinder head.

7. The apparatus of estimating fuel state in claim 1, wherein the branch extraction section performs extraction on a part of the pressure waveform corresponding to a period immediately after completing a pressure increase in response to a finishing of fuel injection.

8. The apparatus of estimating fuel state in claim 7, wherein the injector comprises a first injector to be disposed on a first cylinder of the internal combustion engine and a second injector to be disposed on a second cylinder of the internal combustion engine, and wherein the fuel pressure sensor comprises a first fuel pressure sensor disposed on the first injector and the second fuel pressure sensor disposed on the second injector, and wherein the branch extraction section performs extraction on the pressure waveform obtained by subtracting a non-injected cylinder waveform from an injected cylinder waveform, the non-injected cylinder waveform being detected by the second fuel pressure sensor when the first injector injects fuel, and the injected cylinder waveform being detected by the first fuel pressure sensor when the first injector injects fuel.

9. The apparatus of estimating fuel state in claim 1, wherein the branch extraction section is a band-pass filter which extracts the waveform component in a specific frequency band variable in accordance with at least one of the branch fuel temperature and the average pressure.

10. The apparatus of estimating fuel state in claim 1, wherein the branch extraction section performs extraction on the pressure waveform when an operational status of the internal combustion engine is in a predetermined operational status.

* * * * *